US012116744B2

(12) United States Patent
White

(10) Patent No.: US 12,116,744 B2
(45) Date of Patent: Oct. 15, 2024

(54) DAMPENING ASSEMBLY FOR VIBRATORY PILE DRIVERS

(71) Applicant: John L. White, Seahurst, WA (US)

(72) Inventor: John L. White, Seahurst, WA (US)

( * ) Notice: Subject to any disclaimer, the term of this patent is extended or adjusted under 35 U.S.C. 154(b) by 0 days.

(21) Appl. No.: 17/692,681

(22) Filed: Mar. 11, 2022

(65) Prior Publication Data

US 2023/0287644 A1 Sep. 14, 2023

(51) Int. Cl.
*E02D 11/00* (2006.01)
*E02D 7/18* (2006.01)

(52) U.S. Cl.
CPC ..... *E02D 11/00* (2013.01); *E02D 7/18* (2013.01)

(58) Field of Classification Search
CPC ..... E02D 7/18; E02D 11/00; E02D 13/00; E02D 7/00
See application file for complete search history.

(56) References Cited

U.S. PATENT DOCUMENTS 2,713,791 A * 7/1955 Stewart ..... E02D 1/00 73/845
5,263,544 A * 11/1993 White ..... E02D 11/00 173/162.1
5,522,680 A * 6/1996 Hoss ..... E02B 17/00 405/209
7,080,958 B1 * 7/2006 Morris ..... E02D 13/02 173/210
9,567,192 B2 * 2/2017 Tuenkers ..... E02D 7/18

* cited by examiner

*Primary Examiner* — Sean D Andrish
(74) *Attorney, Agent, or Firm* — Matthew D. Thayne; Thayne and Davis LLC

(57) ABSTRACT

The dampening assembly includes upper and lower members connecting respectively, to a crane and a vibratory pile driver. The dampening assembly includes inner and outer housing members, the inner housing member connected to the outer housing member. The lower member is connected to an inner assembly of the dampening assembly. The inner housing member is connected to the outer housing member. Connected between the inner assembly and the inner housing member are opposing elastomer shock absorbing elements which stretch to varying extents depending upon the weight applied to the vibratory pile driver.

17 Claims, 4 Drawing Sheets

DAMPENING ASSEMBLY FOR VIBRATORY PILE DRIVERS

TECHNICAL FIELD

This invention relates generally to vibratory pile drivers, and more particularly concerns damping mechanisms to reduce shaking and vibration of vibratory pile drivers during operation.

BACKGROUND OF THE INVENTION

During operation of certain vibratory pile drivers, shaking or vibration of the pile driver occurs, particularly during starting and starting of operation, but during the entire operation as well. Such effects are undesirable, for both operators and users of such pile drivers. Various attempts have been made to reduce the shaking/vibration of such pile drivers during operation. One known arrangement is a suppressor system using elastomers, such as shown in U.S. Pat. No. 5,263,544 to White. Such arrangements include multi-stage systems using various elastomer arrangements, all in order to smooth out shaking/vibration during operation of pile drivers. Another arrangement to smooth out shaking is often referred to as damping or a dampening system. In one such arrangement, two opposing plates are arranged with a solid rubber barrel-like member connected between them, operating in compression. This arrangement has had some positive effect in reducing shaking action of pile drivers. An alternative to such a solid rubber arrangement uses an elastomer member in place of the solid rubber member, but also operating in compression which has been shown not to be effective. Further, if the elastomer fails in such an arrangement, the load falls.

Accordingly, an effective dampening system would be advantageous in the pile driving art.

SUMMARY OF THE INVENTION

Accordingly, disclosed is a dampening assembly for use in a pile driving system for pile driving and/or pile pulling, the dampening assembly comprising: a lower connecting member for connection to the vibratory device portion of a pile driving system; an upper connecting member for connecting to a crane assembly for the pile driving system, the upper connecting member connected to an outer housing for the dampening assembly; an inner assembly connected to the lower connecting member, the inner assembly including a safety pin extending through an opening in the outer housing, wherein the dampening assembly includes an inner housing connected to the outer housing; and opposing elastomer shock absorbing members connected between the inner assembly and extending to the inner housing, wherein in operation, weight on the dampening assembly results in a corresponding stretching of the opposing elastomer members, reducing vibration of the pile driving system during operation.

BEST MODE FOR CARRYING OUT THE INVENTION

Figure 1:
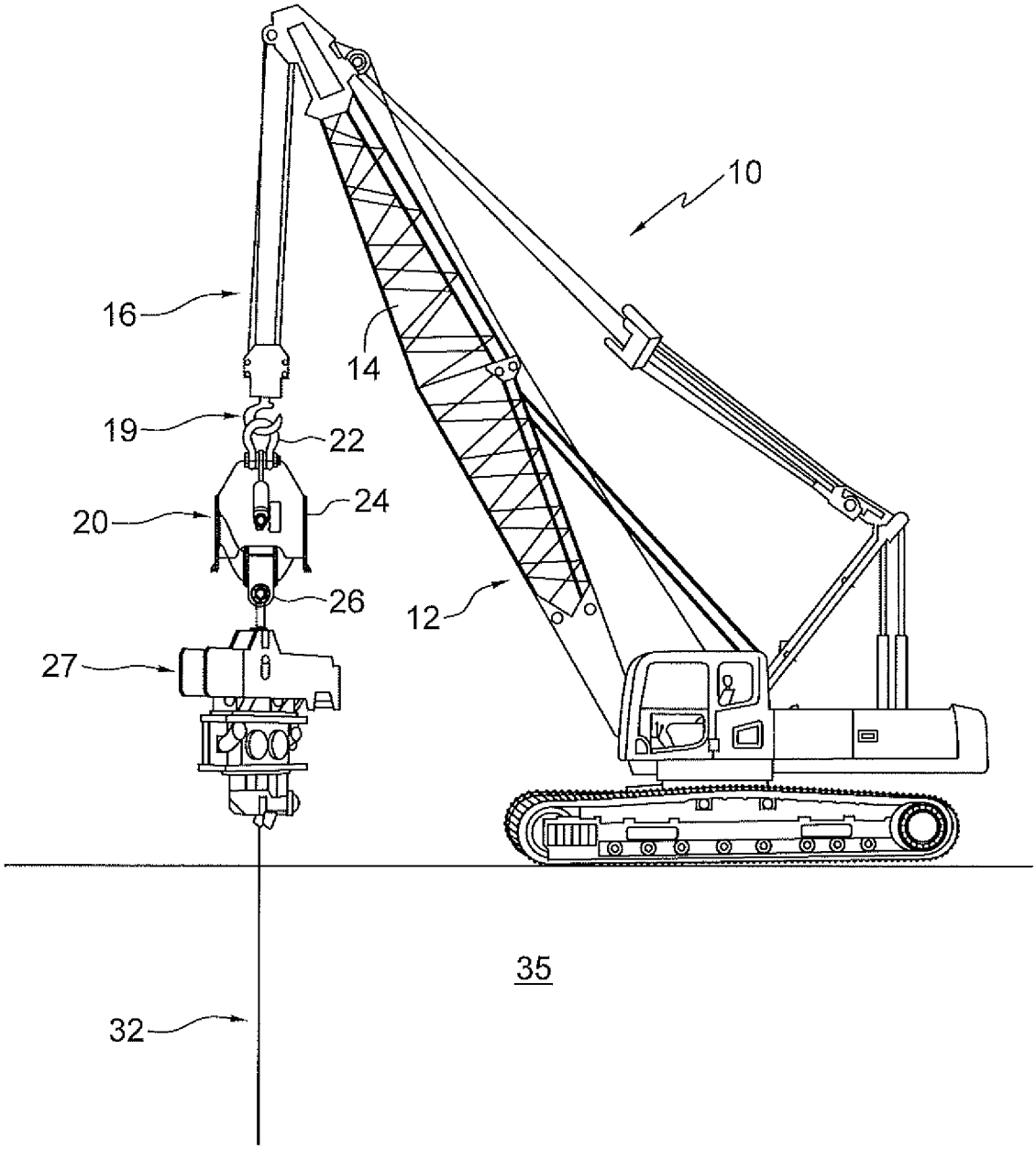
FIG. 1 is a perspective view of a vibratory pile driving system, showing the dampening assembly of the present invention.
Figure 2:
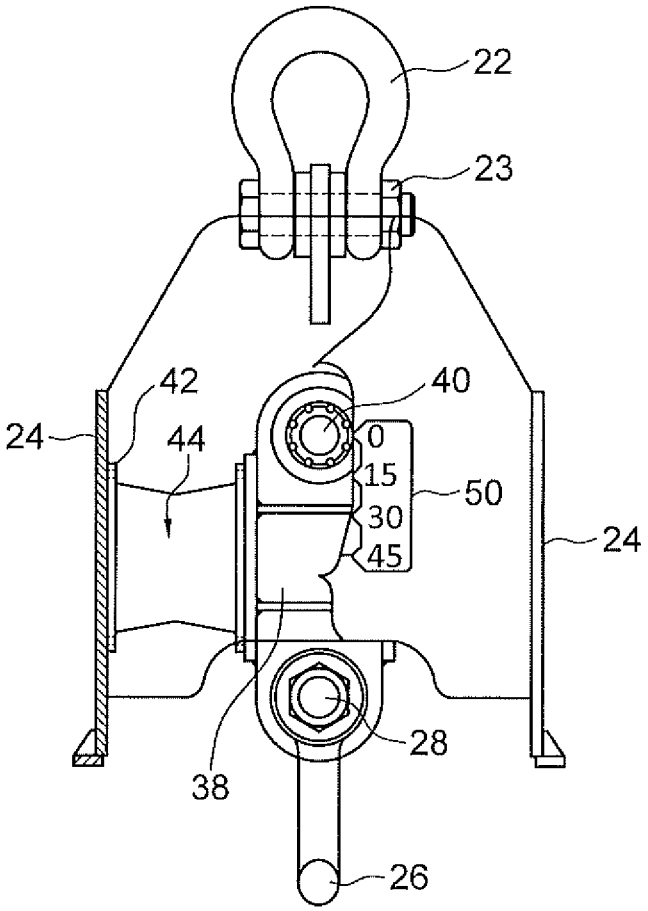
FIG. 2 is an elevational, partially cutaway, view of the dampening assembly of the present invention, without force on the dampening assembly.
Figure 3:
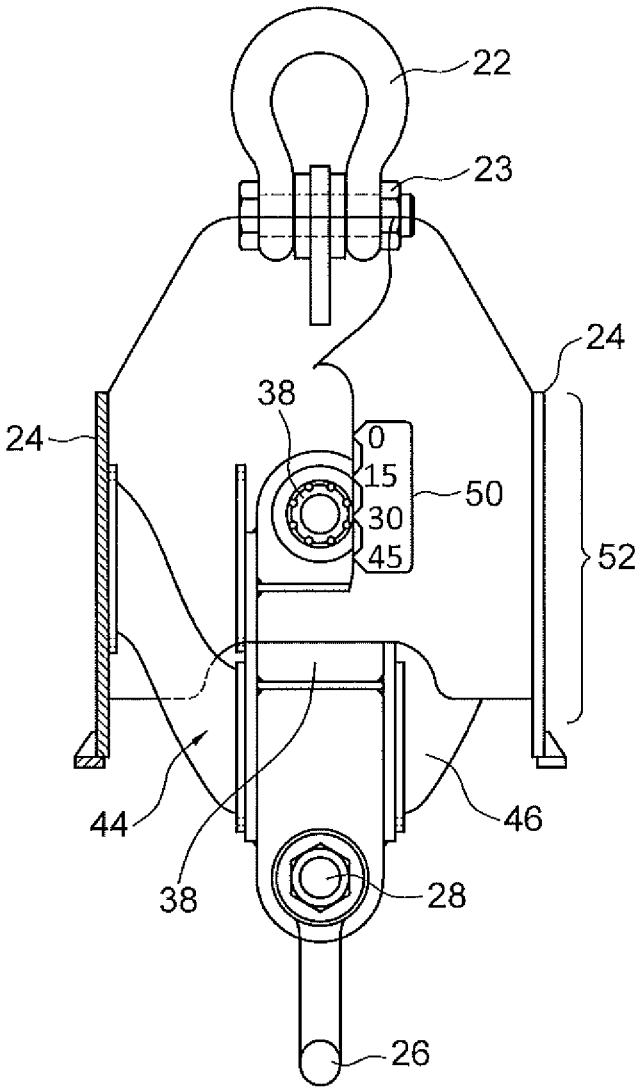
FIG. 3 is an elevational, partially cutaway, view of the dampening assembly, with significant weight on the assembly.

Referring now to FIGS. 1-3, a vibratory pile driver system is shown generally at 10. They system includes a conventional construction crane 12 with an extended boom 14 and a crane line shown at 16. At the end of crane line 16 is a crane hook 19 which is connected the dampening assembly 20 of the present invention, by a first shackle member 22 which is bolted by assembly 23 to an outer housing member 24 of the dampening assembly 20. A second shackle member 26, positioned at 90 degrees to the first shackle member 22, is connected to a vibratory pile driver (vibro) 27 which operates on a pile 32 in the soil 35. The operation/purpose of the arrangement of FIG. 1, including the dampening assembly 20, is to reduce, even significantly reduce, the transfer of vibrations of the vibratory pile driver into the crane line 16 and boom 14. Referring now to FIGS. 2 and 3, the second shackle 26 is connected by a bolt assembly 28 to an inner assembly 38 which includes a pin 40. The inner assembly 38 includes an inner housing 42 which is connected to the outer housing 24. Opposing elastomer shock absorbing members 44 and 46 include inner end plates bolted to the inner assembly 38, extending to the inner housing 42 to which they are also bolted by outer end plates. The elastomeric members 44 and 46 are conventional and well known in the pile driver shock absorbing art. The opposing elastomer members 44 and 46 stretch together during operation of the pile driver. The dampening assembly also includes a weight measuring scale 50 for convenience, but which is not essential for the operation of the dampening assembly. In the embodiment shown, the scale includes weights at 15 ton increments from zero through 45 tons, although the scale could differ in the specific weights measured.

Figure 4C:
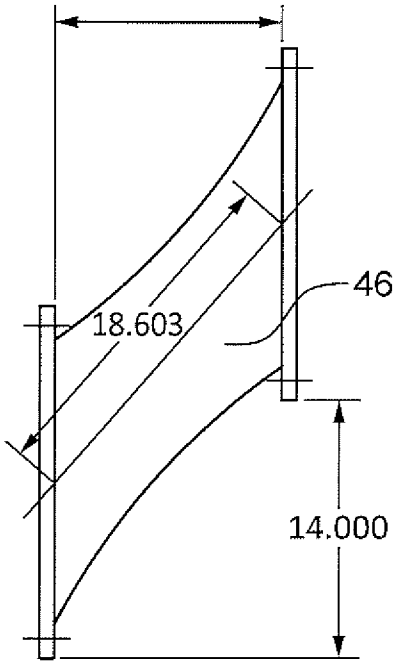
FIG. 4C is a simplified elevational view showing stretching of the elastomer members to 14 inches.
Figure 4B:
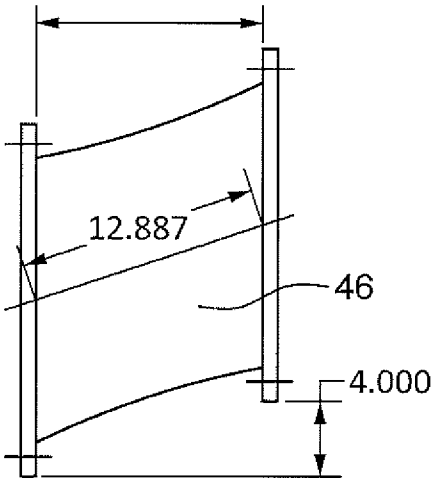
FIG. 4B is a simplified elevational view showing stretching of the elastomer members to 4 inches.
Figure 4A:
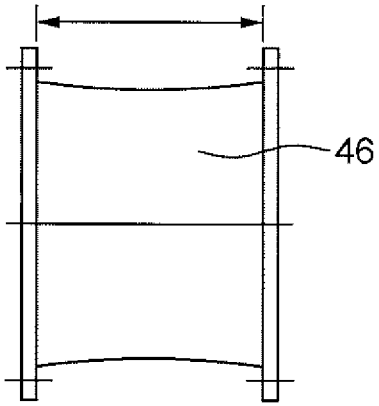
FIG. 4A is a simplified elevational view showing the stretching of the elastomer members of the dampening assembly without any elastomer stretching.

In operation, as weight is applied, the elastomers operate in shear, which is a significant difference relative to other available damping systems which use elastomer(s) operating in compression. Operation of the elastomers in shear is an important aspect of the present invention. FIGS. 4A, 4B and 4C show the condition of the elastomers stretching under 3 weight conditions. In the arrangement shown, the distance between the inner and outer end plates in the elastomers is 12.25 inches, which could be varied. FIG. 4A shows the elastomers under a static (no weight) condition. FIG. 4B shows the elastomers stretched to a length of 13 inches with 4.0 inches of relative movement of the inner assembly produced by 8 tons of weight as an example, while FIG. 4C shows the stretched condition of the elastomers with 14 inches of movement, and a stretched length of 18.6 inches produced by 30 tons of weight. These conditions will vary depending on the weight applied.

It is also important to recognize that with the arrangement of the present invention, if the weight results in a failure or tearing of the elastomers, pin 40 falls to its lowest position in the outer housing, as shown in FIG. 1, but maintains the connection with the vibro so that operation can continue, although shaking/vibration will occur due to the lack of the dampening protection.

It should also be recognized that weights 52 of various amounts can be connected to the exterior of the outer housing, shown on one side only.

Accordingly, a dampening assembly has been disclosed which uses elastomers in a shear arrangement to modulate or modify shaking/vibration during operation of a vibratory pile driver.

Although a preferred arrangement of the present invention has been disclosed for the purpose of illustration, it should be understood that various changes, modifications and substitutions may be incorporated without departing from the spirit of the invention which is defined by the claims that follow:

What is claimed is:

1. A dampening assembly for use in a pile driving system for pile driving and/or pile pulling, the dampening assembly comprising:

a lower connecting shackle member for connection to a suspending weight portion of the pile driving system, the suspending weight portion operating on a pile;

an upper connecting member for connecting to a crane assembly for the pile driving system, the upper connecting member connected to an outer housing for the dampening assembly;

an inner assembly connected to the lower connecting shackle member, the inner assembly including a safety pin extending through an opening in the outer housing;

wherein the inner assembly includes an inner housing connected to the outer housing; and opposing elastomer shock absorbing members connected between the inner assembly and the inner housing, wherein in operation, weight on the dampening assembly results in a corresponding stretching of the opposing elastomer shock absorbing members, reducing vibration of the pile driving system during operation.

2. The dampening assembly of claim 1, wherein the elastomer shock absorbing members have end plates at one end thereof connected to the inner assembly and plates at the other end thereof connected to the inner housing.

3. The dampening assembly of claim 1, wherein the safety pin is configured to fall downwardly to and contact a lower end of the opening in the outer housing when the elastomer shock absorbing members fail.

4. The dampening assembly of claim 1, wherein the outer housing is configured to allow for connection of selected weights to the outer housing.

5. The dampening assembly of claim 1, wherein the lower connecting shackle member is positioned at 90 degrees to the upper connecting member.

6. The dampening assembly of claim 1, wherein the upper connecting member is a shackle.

7. The dampening assembly of claim 1, wherein the suspending weight portion is a vibratory device.

8. A dampening assembly for use with a crane system subject to vibration, the dampening assembly comprising:

an upper connecting member for connecting to a crane line portion of the crane system, the upper connecting member connected to an outer housing of the dampening assembly;

a lower connecting member for releasably connecting to a weight which would otherwise be connected to the crane line portion of the crane system;

an inner assembly connected to the lower connecting member, the inner assembly including a safety pin extending through an opening in the outer housing;

wherein the inner assembly includes an inner housing connected to the outer housing; and opposing elastomer shock absorbing members connected between the inner assembly and the inner housing, wherein in operation, the weight connected to the dampening assembly results in a corresponding stretching of the opposing elastomer shock absorbing members, thereby reducing vibration of the crane system during operation.

9. The dampening assembly of claim 8, wherein the elastomer shock absorbing members have end plates at one end thereof connected to the inner assembly and end plates at the other end thereof connected to the inner housing.

10. The dampening assembly of claim 8, wherein the safety pin is configured to fall downwardly to a lower end of the opening in the outer housing when the elastomer shock absorbing members fail.

11. The dampening assembly of claim 8, wherein the outer housing is configured to allow for connection of selected weights to the outer housing.

12. The dampening assembly of claim 8, wherein the lower connecting member is positioned at 90 degrees to the upper connecting member.

13. The dampening assembly of claim 8, wherein the upper connecting member and the lower connecting member are shackles.

14. A dampening assembly, comprising:

an upper connecting member;

a lower connecting member;

an outer housing coupled to the upper connecting member;

an inner assembly coupled to the lower connecting member;

at least one elastomeric member coupled between the outer housing and the inner assembly such that weight applied to the lower connecting member results in movement of the inner assembly relative to the outer housing and shearing of the at least one elastomeric member, wherein the at least one elastomeric member comprises a pair of opposing elastomeric members; and a safety member configured to prevent failure of the pair of opposing elastomeric members from causing the dampening assembly to release the weight, wherein the safety member comprises a safety pin, and wherein the lower connecting member comprises a shackle member configured to be releasably connected to a vibratory pile driver.

15. The dampening assembly of claim 14, further comprising a scale configured to provide a measurement of the weight applied to the lower connecting member.

16. The dampening assembly of claim 14, wherein the safety pin extends through an opening formed in the outer housing.

17. The dampening assembly of claim 16, wherein the safety pin is configured to contact a lower portion of the opening to prevent disconnection of the inner assembly and the outer housing upon failure of the pair of opposing elastomeric members.

* * * * *